US006076387A

United States Patent [19]

Siewert et al.

[11] Patent Number: 6,076,387

[45] Date of Patent: Jun. 20, 2000

[54] PROCESS FOR ROLLING BEVEL GEARS ON AN AXIAL STAMPING ROLLING MACHINE AND TOOLING FOR ITS IMPLEMENTATION

[75] Inventors: Frank Siewert, Dortmund; Werner Sczesny, Bochum, both of Germany

[73] Assignee: WDB Ringwalztechnik GmbH, Witten, Germany

[21] Appl. No.: 09/180,214

[22] PCT Filed: May 2, 1997

[86] PCT No.: PCT/EP97/02255

§ 371 Date: Nov. 17, 1998

§ 102(e) Date: Nov. 17, 1998

[87] PCT Pub. No.: WO97/41982

PCT Pub. Date: Nov. 13, 1997

[51] Int. Cl.[7] ..... B21H 5/04

[52] U.S. Cl. ..... 72/69; 29/893.32; 72/84

[58] Field of Search ..... 72/67, 69, 84, 72/102; 29/893.32

[56] References Cited

U.S. PATENT DOCUMENTS 1,377,177 5/1921 Anderson ..... 72/84

1,817,035 8/1931 Hughes ..... 72/84

FOREIGN PATENT DOCUMENTS 1518059 10/1989 Russian Federation ..... 72/67

*Primary Examiner*—Lowell A. Larson

*Attorney, Agent, or Firm*—Herbert Dubno; Andrew Wilford

[57] ABSTRACT

Teeth are ring rolled in a closed die formed between upper and lower clamping elements in a starting workpiece that is a pretreated blank whose shape outside a region to be deformed by upper and lower profiled tools already corresponds generally to a desired finished shape. Prior to rolling the region to be deformed is heated and the upper profiled tool together with the upper synchronously rotating clamping element form a closed cavity around the heated region to be deformed of the workpiece with the upper tool angled relative to the workpiece. The tools and elements are rotated while engaging the workpiece and deformation takes place between the rotating tools. The angled upper tool is advanced along its symmetry line into the workpiece as the workpiece is deformed. The upper clamping element is axially retracted opposite to the upper tool and away from the workpiece during the rolling process along the symmetry line of the upper profiled tool as the workpiece is deformed.

7 Claims, 3 Drawing Sheets

PROCESS FOR ROLLING BEVEL GEARS ON AN AXIAL STAMPING ROLLING MACHINE AND TOOLING FOR ITS IMPLEMENTATION

CROSS REFERENCE TO RELATED APPLICATIONS

This application is the US national phase of PCT application PCT/EP97/02255 filed May 2, 1997 with a claim to the priority of German application 196 17 531.3 filed May 2, 1996.

FIELD OF THE INVENTION

The present invention relates to a method of and tool system for ring rolling or roll forming teeth of bevel gears.

BACKGROUND OF THE INVENTION

The standard method of ring rolling teeth of bevel gears with hypoid toothings normally starts with a pretreated blank whose shape outside the region to be deformed by profiled tools already corresponds to the desired finished shape. Prior to the rolling the region to be deformed is heated and then the profiled tool together with at least one synchronously rotating clamping device are positioned to form a closed cavity around the heated region to be deformed of the workpiece. The deformation takes place between two rotating tools and the angled upper tool is advanced along its symmetry line during the rolling.

The tool system for carrying out this method comprises two rotating tools that are inclined relative to each according to the shapes of the bevel gears to be produced. The upper profiled tool is advanced axially in a direction along its symmetry line and the region of the workpiece to be shaped during the rolling process is held in a closed cavity that is formed by the upper profiled tool and at least one synchronously rotating clamping device.

German 3,526,796 describes a method wherein workpieces are produced by advancing the upper tool in the direction of the fixed angle set in the machine of the hole upper tool. Naturally there is no means for adjusting the angle of inclination. The radial limits of the material flow are defined by fixedly connected clamping elements. Synchronization of the tools' rotations is ensured by toothed synchronizers near the tools, the gears being adjusted under load according to the roller advance, a process that obviously is subject to considerable wear.

German 2,611,568 furthermore shows a method of making annular workpieces with highly profiled sections and a roller tool to carry out the method, where two relatively adjustable rollers set at a fixed angle to each other and of which at least one is driven to produce the negative of the profile to be rolled. The angle is fixed by the machine and naturally there is no system for adjusting the angle of inclination. With this so-called axial die rolling there is above all no production of a tangential profiling on the back side of the workpiece and there is naturally no profiling corresponding to the tools as well as clamping device and kinematic coupling of the tools.

German 1,812,423 also describes a machine for rolling or roll-hobbing teeth in bevel gears where the toothed roller tool is fixed on a steppedly advanced spindle that works together with a spindle carrying the workpiece blank and in which one of the spindles is pivoted on a link whose axis is perpendicular to a plane that extends through the spindle axes.

OBJECTS OF THE INVENTION

It is an object of the invention to produce a method of this type and an apparatus for carrying out this method where the plastic deformation of the profile to be produced, in particular in the edges or corners of the teeth, is improved and the cycling time is reduced.

SUMMARY OF THE INVENTION

This object is attained according to the invention in a method of ring rolling teeth of bevel gears in a closed die formed between upper and lower clamping elements wherein the starting workpiece is a pretreated blank whose shape outside a region to be deformed by upper and lower profiled tools already corresponds generally to a desired finished shape, prior to rolling the region to be deformed is heated, the upper profiled tool together with the upper synchronously rotating clamping element form a closed cavity around the heated region to be deformed of the workpiece with the upper tool angled relative to the workpiece, the tools and elements are rotated while engaging the work piece and deformation takes place between the rotating tools, and the angled upper tool is advanced along its symmetry line into the work piece as the workpiece is deformed. In accordance with the invention the upper clamping element is axially retracted opposite to the upper tool and away from the workpiece during the rolling process along the symmetry line of the upper profiled tool as the workpiece is deformed.

The use according to the invention of the axial-deformation rolling method with relatively inclined tools to produce annular workpieces with tangential profilings on the upper side makes it possible that during rolling only a portion of the annular surface of the workpiece is acted on so that substantially smaller pressures are used. The tangential profiling is produced solely in that the workpiece material flows mainly axially into the tangentially profiled upper tool. On advance of the upper tool at least the inner clamping element of the clamping device is simultaneously retracted in order to ensure the deformation of the profiling to be produced so that relative movement between the tool and clamping device takes place. As a result of the thus improved friction relationships workpiece material is "drawn" into the corners. The inner clamping element is shifted parallel to the rotation axis of the upper tool. In axial deformation rolling a preformed workpiece blank is set in place that corresponds to the finished workpiece except for the region of the teeth. As the upper tool is advanced the inner clamping element is set on the web of the bevel gear and forms together with the outer clamping element that is formed by the axially unmoving lower tool a closed cavity for the deformation. Then the die is pushed into the blank and forms the teeth. Due to the advance of the die (upper tool) relative to the fixed outer die (lower tool) as well as to the retractable inner clamping element (also the upper tool) withdrawn by a microrotating hydraulic cylinder, there is relative movement between the clamping elements and the die that lead to a better die filling in the corners.

The workpiece according to the invention is preferably only partially heated in the region to be deformed and is secured by a remotely actuated clamping device against tipping and turning. The heating of the workpiece takes place outside the rolling station such that continuous operation without waiting time for heating is possible. Loading of the rolling station takes place directly from the integrated heating device and always in the same amount of loading time so that variations in process results are minimized. The exact cycling of the loading of the heating device is effected wholly automatically by a transport device acting as temporary storage.

BRIEF DESCRIPTION OF THE DRAWING

The invention is described in the following with reference to FIGS. 1 to 3 in which.

SPECIFIC DESCRIPTION

Figure 1:
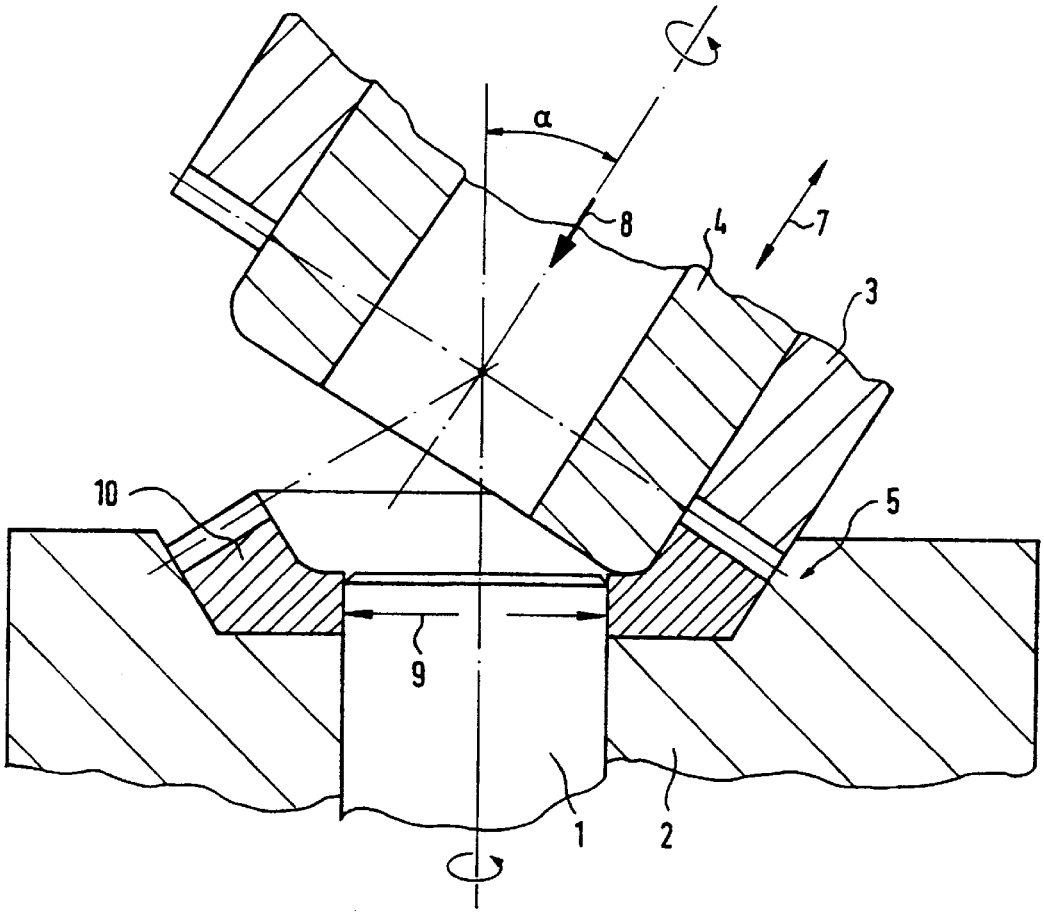
FIG. 1 shows by way of example in section the rolling station according to the invention.

According to FIG. 1 the upper tool 3 and the clamping system 1, 4 are arranged inclined at an angle α, the feed direction 8 of the upper tool 3 coinciding with the symmetry line of the upper bearing. Variable setting of the angle α ensures that the rolling line of the machine (production rolling line) is always on the rolling line of the profile to be produced. At the end of the rolling process the tool 3 meshes with the produced profile of the workpiece 10 like a known bevel gearing. The clamping element 4 closes for example the gaps between teeth of the upper tool 3 while the advance in direction 7 of the inner clamping element 4 of the clamping system 1, 4 parallel to the feed direction 8 takes place such that ideally without contact of the tool 10 in the feed direction during deformation there is a movement relative to the upper workpiece 3. The outer clamping tool 5 is connected with the lower tool 5 that once again is not axially moved. The deformation of the workpiece 10 is determined by the profile of the tool 3 that is fed in the direction 8 toward the tool 2 until the final shape of the workpiece 10 is achieved and the workpiece material flows mainly axially into the cavities of the tool 3. The clamping element 1 with feed direction 9 extends out of the tool 2 and holds the workpiece 10 centrally so as simultaneously to prevent tipping of the workpiece 10 or relative rotation. Unloading the rolling station with rotating tools is done by a conventional unloading device.

Figure 2:
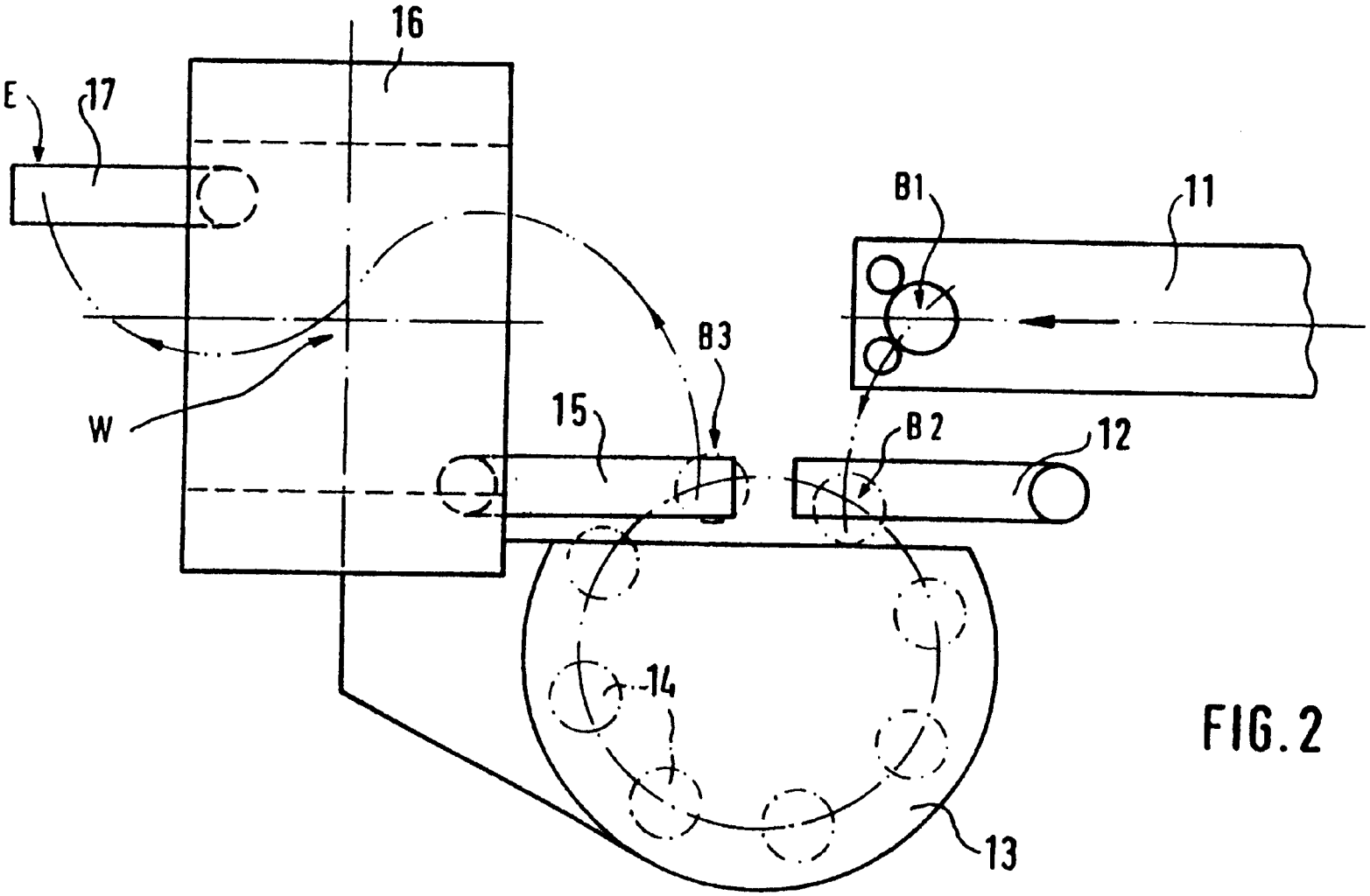
FIG. 2 shows schematically in top view the loading B, rolling W, and unloading E.
Figure 3:
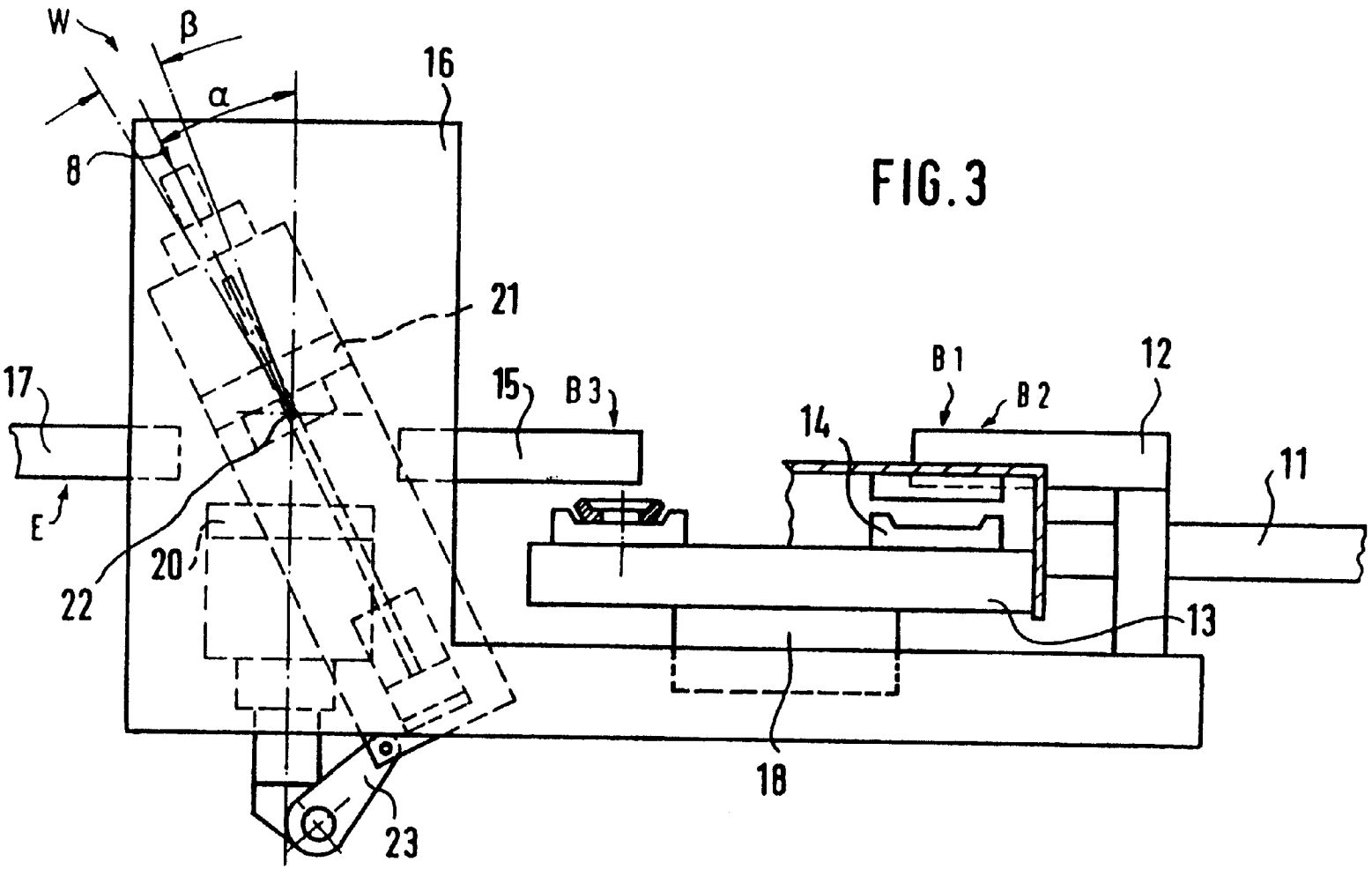
FIG. 3 shows a side view of FIG. 2.

FIGS. 2 and 3 schematically show the rolling station W according to FIG. 1, with a loading device 15 and an unloading device 17 for the rolling station W. Outside the rolling station W there is in the reach of the loading device 15 the heating device 13 that itself is loaded by the station B1 and the loading device 12.

In addition the heating device 13 has one or more heating stations 14 beneath which the workpieces, after they are properly picked up by one or more holders, are set sequentially, for example by rotating the support plate above the drive 18. The number of heating stations 14 is determined by the necessary heating time and the cycling time of the machine. If necessary it is possible to put the device for heating in a closed space, for example filled with a protective gas. The heating device 13 is downstream of a transport device 11 for the workpieces 10 to be heated.

Setting the production roll line of the machine on the drive roll line of the profile to be produced is done relative to the rotation point 22 such that in the adjustment range β different angles α can be set, with the device determining the feed direction 8 of the upper tool simultaneously being adjusted. In this manner the feed force is always effective in the direction of the symmetry line of the upper tool.

The replaceable upper unit 21 includes the tool 3 and the clamping element 4. The replaceable lower unit 20 includes the tool 2, the clamping element 1, and the tool 2. The drive of the rolling station 16 is effected with at least one rotary drive such that an uninterrupted kinematic coupling of the two axes inclined to each other at the angle α takes place with a predetermined transmission ratio of the rotation speeds of the upper and lower tool axes.

A mechanical coupling is effected for example with a drive by providing a crown gear at rotation point 22 in which the symmetry line of the toothed shafts following the upper and lower tool axes mesh. An electrical coupling can also naturally be done with known drives for the upper and lower tool shafts.

With the known method there are the following general working steps:

1. The workpiece is picked up in the loading station B1 and transferred to the loading station B2. It runs through the heating device 13 such that preferably only the regions on the end of the workpiece to be deformed are heated.

2. Subsequently the workpiece is transferred from the loading station B2 to the loading station B3 and goes into the rolling station 16. The clamping element 1 holds the inside diameter of the workpiece 10 centered in the tool 2. As the tool 3 is advanced during the rolling process the clamping element 4 is pulled back. After ending of the rolling process and separation of the tools 2 and 3, the unloading device 17 moves into the rolling station 16 and the clamping element 1 releases the workpiece 10.

3. After swinging back of the unloading device 17 the workpiece 10 is transferred to the unloading station 17.

REFERENCE NUMBER LIST

1 clamping device for 10
2 lower tool (not advanced)
3 upper tool 3
4 inner element of the clamping device
5 outer element of the clamping device
7 feed direction for 4
8 feed direction 8 for 3 (perpendicular to 2)
9 feed direction for 1
10 tool
11 transport device for 10
12 loading device for 13
13 heating device for 10
14 heating stations for 10
15 loading device for 16
16 rolling station
17 unloading device for 16
18 feed for 14
20 support for 1 and 2, lower unit
21 support for 3 and 4, upper unit
22 rotation point for 3
23 adjustment direction for α
α angle between 8 and ½ β
β adjustment range for α
W rolling station
B1, B2 loading station for 13
B3 loading station for 16
E unloading station for 16

We claim:

1. In a method of ring rolling teeth of bevel gears in a closed die formed between upper and lower clamping elements wherein the starting workpiece is a pretreated blank whose shape outside a region to be deformed by upper and lower profiled tools already corresponds generally to a desired finished shape;

prior to rolling the region to be deformed is heated;

the upper profiled tool together with the upper synchronously rotating clamping element form a closed cavity around the heated region to be deformed of the workpiece with the upper tool angled relative to the workpiece;

the tools and elements are rotated while engaging the workpiece and deformation takes place between the rotating tools; and the angled upper tool is advanced along its symmetry line into the workpiece as the workpiece is deformed, the improvement comprising the step wherein the upper clamping element is axially retracted opposite to the upper tool and away from the workpiece during the rolling process along the symmetry line of the upper profiled tool as the workpiece is deformed.

2. The method according to claim 1, further comprising the step of coupling together drives of the two rotating tools mechanically or electrically outside a tool area.

3. The method according to claim 1 wherein one or more blanks are heated before rolling outside the rolling apparatus.

4. A tool system for ring rolling teeth of bevel gears, the system comprising two rotating upper and lower profiled tools that are inclined relative to each according to the shapes of the bevel gears to be produced;

upper and lower clamping elements, the upper element forming with the upper tool a closed cavity holding a region to be shaped of a workpiece; and means for advancing the upper profiled tool axially in a direction along its symmetry line toward the workpiece while retracting the upper clamping element oppositely away from the workpiece.

5. The tool system according to claim 4 wherein at least the lower clamping element has a mechanical or hydraulic feed device.

6. The tool system according to claim 4 wherein the upper clamping element surrounds at least the gaps between teeth of the upper tool.

7. The tool system according to claim 4, further comprising means for bracing the lower clamping element at the start of the rolling process against the workpiece.

* * * * *